US009394717B2

(12) United States Patent
Paananen

(10) Patent No.: US 9,394,717 B2
(45) Date of Patent: Jul. 19, 2016

(54) GROUND ANCHOR WITH TILT COMPENSATION

(71) Applicant: Tuomo Paananen, Kumpumaki (FI)

(72) Inventor: Tuomo Paananen, Kumpumaki (FI)

( * ) Notice: Subject to any disclaimer, the term of this patent is extended or adjusted under 35 U.S.C. 154(b) by 0 days.

(21) Appl. No.: 14/434,411

(22) PCT Filed: Oct. 8, 2013

(86) PCT No.: PCT/FI2013/000036

§ 371 (c)(1),
(2) Date: Apr. 9, 2015

(87) PCT Pub. No.: WO2014/057161

PCT Pub. Date: Apr. 17, 2014

(65) Prior Publication Data

US 2015/0259943 A1 Sep. 17, 2015

(30) Foreign Application Priority Data

Oct. 9, 2012 (FI) ..... 20126054

(51) Int. Cl.
*E04H 12/22* (2006.01)
*E04H 17/22* (2006.01)
*E04H 12/34* (2006.01)

(52) U.S. Cl.
CPC ..... *E04H 12/347* (2013.01); *E04H 12/2215* (2013.01); *E04H 12/2269* (2013.01); *E04H 17/22* (2013.01); *E04H 12/2284* (2013.01)

(58) Field of Classification Search
CPC . E04H 12/22; E04H 12/2215; E04H 12/2223; E04H 12/2253; E04H 12/2269; E04H 12/2284; E04H 12/223; E04H 17/22; E04H 17/265; E04H 17/263; E04H 12/347; E04H 12/2261; E02D 5/801; E02D 5/803; E02D 5/80; E02D 27/42; E02D 27/50; A45B 17/00; A45B 2017/005; A45B 2023/0012; A01G 9/122; A45F 3/44
USPC ..... 52/155–159, 162, 164, 169.1, 679.1, 52/126.1, 165; 135/118, 20.1; 248/530, 248/545, 156; 256/65.14, DIG. 1
See application file for complete search history.

(56) References Cited

U.S. PATENT DOCUMENTS 427,815 A * 5/1890 Wolf ..... 52/165
1,543,391 A * 6/1925 Knopke ..... 52/153

(Continued)

FOREIGN PATENT DOCUMENTS

DE 4134945 A1 4/1993
GB 2235937 A 3/1991

*Primary Examiner* — Elizabeth A Quast
*Assistant Examiner* — Kyle Walraed-Sullivan
(74) *Attorney, Agent, or Firm* — Berggren Inc.

(57) ABSTRACT

During ramming of a metal ground anchor for a fence post by applying force on its top plate, the anchor is often tilted, subsequently resulting in the tilted fence post. The tilt is compensated by utilizing a compensation plate (13), the dimensions and form of which correspond to the dimensions and form of the top plate (11) welded onto the ground anchor (10). The compensation plate is located above the top plate (11) and a post holder (2) is attached thereto. Downwards-protruding mounting flanges (131, 137) are located on two opposite edges of the compensation plate, aligning with downwards-protruding fixing flanges of the top plate. Elongated adjustment slots (132, 133) in the mounting flanges are aligned with holes in the fixing flanges of the top plate, enabling the flanges to be attached with bolts. The adjustment slots allow adjusting the compensation plate before the bolts are tightened.

13 Claims, 8 Drawing Sheets

(56) References Cited

U.S. PATENT DOCUMENTS 3,204,898 A * 9/1965 Manning ..... 248/516
3,775,924 A * 12/1973 McClure, Jr. ..... 52/155
3,823,785 A * 7/1974 Toliver ..... 173/90
3,996,707 A * 12/1976 Frye ..... 52/157
4,271,646 A * 6/1981 Mills ..... 52/165
4,279,107 A * 7/1981 Bollmann ..... E02D 27/42 403/86
4,603,520 A * 8/1986 Deike ..... 52/98
4,644,713 A * 2/1987 Lehman ..... 52/165
4,790,533 A * 12/1988 Potthast, Sr. ..... 473/499
4,863,137 A * 9/1989 Cockman et al. ..... 248/545
4,923,165 A * 5/1990 Cockman ..... 248/545
5,011,107 A * 4/1991 Reece ..... E04H 12/2223 248/156
5,028,166 A * 7/1991 Leishman ..... 404/10
5,123,623 A * 6/1992 McNamara ..... 248/545
5,396,743 A * 3/1995 Bellette ..... 52/154
5,404,682 A * 4/1995 West ..... 52/165
5,428,927 A * 7/1995 Webb et al. ..... 52/156
5,695,174 A * 12/1997 Tsai ..... 256/22
5,709,366 A * 1/1998 Speece ..... 248/530
5,884,874 A * 3/1999 Speece et al. ..... 248/516
5,901,526 A * 5/1999 Vidmar et al. ..... 52/745.09
6,021,600 A * 2/2000 Everett ..... 47/33
6,039,298 A * 3/2000 Stier ..... E04H 12/2215 248/156
6,202,367 B1 * 3/2001 Marino et al. ..... 52/102
6,213,452 B1 * 4/2001 Pettit ..... E04F 11/1812 248/188.8
6,272,798 B1 * 8/2001 Cockman ..... E02D 5/801 135/118
6,347,489 B1 * 2/2002 Marshall, Jr. ..... E02D 27/00 248/354.5
6,685,155 B1 * 2/2004 Chen ..... A63B 61/02 248/156
6,971,209 B1 * 12/2005 Blevins ..... E02D 5/801 248/156
7,802,351 B2 * 9/2010 McGinness ..... E04H 12/2253 256/65.14
8,572,905 B1 * 11/2013 Driggers ..... E02D 27/42 52/169.13
8,959,857 B1 * 2/2015 Lin ..... E04H 12/2261 256/65.14
9,045,892 B2 * 6/2015 Smith ..... E04B 1/003
2001/0018978 A1 * 9/2001 Gordin et al. ..... 174/2
2004/0206020 A1 * 10/2004 Stuart ..... 52/169.1
2005/0188627 A1 * 9/2005 Alberts ..... 52/166
2006/0180719 A1 * 8/2006 Cooper ..... 248/156
2006/0278772 A1 * 12/2006 Walker ..... 248/156
2007/0235602 A1 * 10/2007 Gross et al. ..... 248/156
2007/0267552 A1 * 11/2007 Meyer ..... E04H 12/2276 248/156
2008/0104899 A1 * 5/2008 Hill ..... 52/165
2008/0179579 A1 * 7/2008 McGinness et al. ..... 256/64
2009/0133337 A1 * 5/2009 Hill ..... 52/165
2009/0313916 A1 * 12/2009 Zhu et al. ..... 52/155
2010/0127231 A1 * 5/2010 Langenwalter ..... 256/65.01
2011/0036026 A1 * 2/2011 Lee ..... 52/157
2011/0204198 A1 * 8/2011 Leary ..... E04H 17/263 248/346.03
2012/0192507 A1 * 8/2012 Paananen ..... 52/155
2012/0321826 A1 * 12/2012 Mukith ..... B29C 7/0019 428/34.1
2013/0263532 A1 * 10/2013 Dabkowski ..... 52/165
2015/0159337 A1 * 6/2015 Kellner ..... 52/155
2015/0247336 A1 * 9/2015 Bergman ..... E04H 12/2223 52/157

* cited by examiner

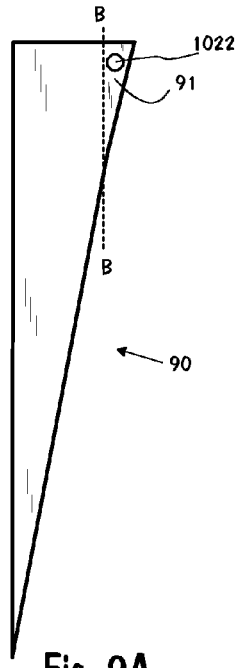
Fig. 9A
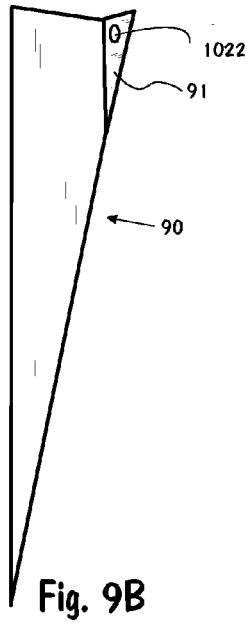
Fig. 9B
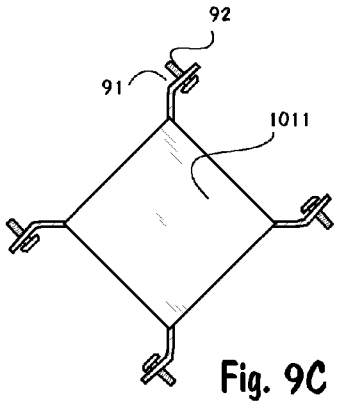
Fig. 9C
Fig. 9
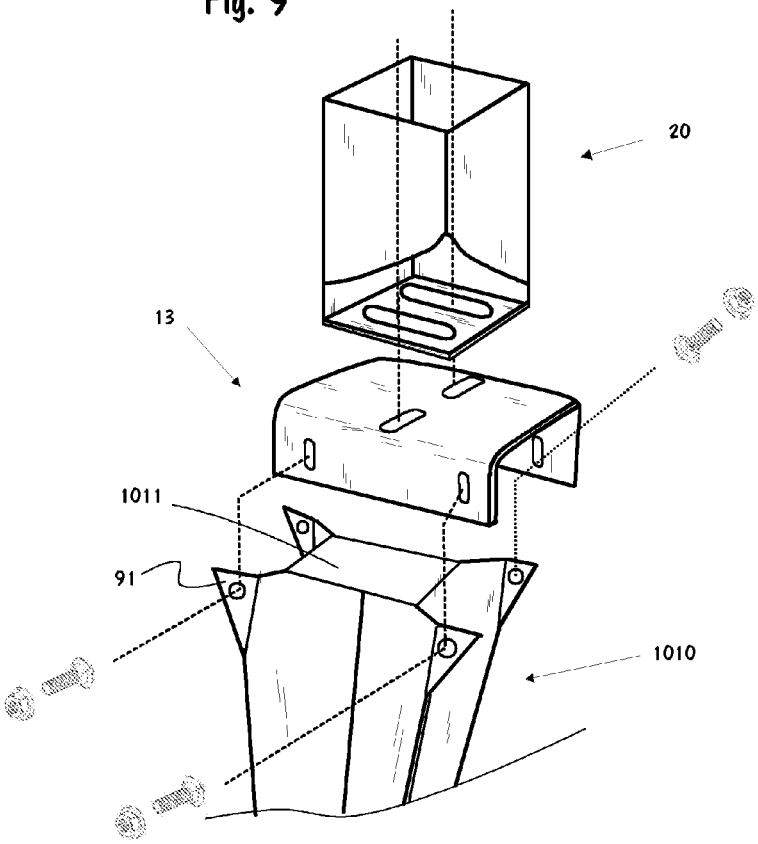
Fig. 10

GROUND ANCHOR WITH TILT COMPENSATION

TECHNICAL FIELD

This invention features a ground anchor which can be rammed or screwed into the ground, and has a screw or wedge on the lower part and a post socket on the upper part.

BACKGROUND ART

For installing light pillars, such as fence posts, it is used a zinc-coated steel anchor consisting of a wedge-shaped ground-protruding portion and a welded socket on its top, wherein the pillar is inserted into the socket. Posts of different diameters require different sizes of ground anchors. A benefit of this type of ground anchor is its simple, affordable structure and ease of installation. A drawback, however, is its lack of adjustability: each standard size post requires its own fixed anchor/socket combination. Furthermore, this type of ground anchor must be rammed into the ground completely vertically and precisely in the right point. Otherwise the Fence post may be skewed and displaced from the right point. It is practically impossible to align consecutive posts exactly.

Finnish patent No. 115988 describes a ground anchor where a post socket is bolted on a flange welded to the top of the wedge part. Before the bolt connection is tightened, the position of the socket in relation to the flange can be adjusted owing to slots located on the bottom of the flange and the socket. This enables horizontal adjustment of the flange, making it easier to make a straight line of fence posts. A drawback is that when the wedge is slightly tilted during ramming, the post mounted into the socket will also be tilted.

Applicant's patent application U.S. Ser. No. 13/359,757 presents a significant improvement in the adjustability. It describes a ground anchor with two parallel grooves located on a top plate of the wedge part. There are two L-shaped brackets attached to the end plate. The flange of the L-bracket that is against the top plate has a elongated slot parallel to the flange crease. A fence post is inserted between the upwards-pointing flanges of the L-brackets. Bolts are inserted first through the slots in the top plate and through the slots in the brackets and the nuts are lightly tightened. The slots enable free movement of the brackets on the top plate. This subsequently enables the L-brackets to be adjusted in order to achieve a direct post line, after which the nuts are tightened.

A benefit of the solution described in that patent application is that the adjustable distance between the L-brackets enables the same ground anchor to be used for posts of various sizes. Additionally, if the ground anchor is tilted during ramming, as is the case almost every time, the tilting can be compensated by, for example, bending the upwards-protruding flanges of the brackets with a sledge hammer to straighten the post installed between the brackets. The flanges can also be straightened by bending the fence post installed between the brackets. In practice, however, bending the flanges is not easy, particularly if the L-brackets are made of thick steel plate. This may result in an uneven bending of the flanges, making it nearly impossible to make the flanges parallel to each other.

In fence construction it happens very often that the ground anchor hits a rock during ramming which causes tilting of the anchor. This, subsequently, results in a tilted post. Most commonly used ground anchors make it impossible or, in case a ground anchor of U.S. Ser. No. 13/359,757 is used, difficult to correct the tilt.

An objective of this invention is to devise a ground anchor which is free of the disadvantages that the known ground anchors have. More precisely, the objective is to devise an adjustable ground anchor which not only allows horizontal adjustment of the position of a post prior to its installation, but which enables compensation of the tilting caused by a tilted ground anchor so that a fence post becomes completely upright.

BRIEF SUMMARY OF THE INVENTION

The objective is achieved with a ground anchor having tilt compensation as defined in claim 1.

Tilt compensation is achieved with an adjustable compensation plate located between a top plate, which acts as a ramming plate, and a post socket of the anchor. The dimensions of the compensation plate are equal to the dimensions of the top plate of the anchor and it is provided with one or more mounting flanges projecting downward from its two opposite edges, the mounting flange having an elongated slot for a through bolt.

The anchor part of the ground anchor has vertical fixing flanges projecting downward from the surface level of the top plate. These fixing flanges have a hole for the through bolt.

In one embodiment the top plate that serves as a ramming plate covers the entire top area of the anchor part and two vertical fixing flanges projecting downward from two opposite sides contain one or more holes for mounting through bolts.

In another embodiment the fixing flanges are created by bending the top parts of the anchor plates. The fixing flanges are bent parallel to the longitudinal axle of the anchor. In this embodiment the anchor consists of four wedge-shaped plates welded together along their longer edges with each plate at a 90-degree angle to the adjacent plate. The outer tips of adjacent plates are parallel to one another. The opposite plates are bent similarly.

The compensation plate features two parallel slots allowing the mounting of L-brackets or a sleeve to it with through bolts.

Alternatively, the compensation plate can feature a protrusion in its center area, the height of which is at least equal to the height of the head of the bolt used for mounting the L-brackets or the sleeve.

Once the corner plates or the sleeve used for mounting the post has been lightly mounted on the compensation plate so that the bolt head is within the slot of the compensation plate and the nut is on the top of the L-bracket or the bottom of the sleeve, the compensation plate is placed on top of the top plate of the anchor so that the mounting flange/flanges located on the opposite edges of the compensation plate align on the fixing flanges. Once the holes in the mounting flange and the fixing flange are aligned, bolts are inserted from inside and the compensation plate is mounted by initially tightening the nuts lightly.

The elongated slots located in the flanges of the compensation plate allow the plate to be tilted in any direction in relation to the ground anchor end plate A post can then be loosely mounted. If the post is tilted, it can be straightened by adjusting the post, wherein the compensation plate tilts simultaneously. Once the right angle to the horizon is verified with a bubble level, the nuts are tightened till final tightness. This is followed by positioning the L-brackets or sleeve into their correct horizontal positions, tightening the bolts and finishing with mounting of the post.

By utilizing a compensation plate described here, even significant tilting of the ground anchor can be compensated for in order to achieve a completely vertical post.

Another benefit of the invention is that if the post is tilted at a later stage due to ground frosting or otherwise, the post can easily be straightened by loosening the compensation plate bolts, correcting the position of the post, and by re-tightening the bolts.

BRIEF DESCRIPTION OF THE DRAWINGS

The invention is described with reference to the following drawings, where:

FIG. 9A-C depict the fixing flanges formed by bending the anchor flanges;

FIG. 10 is an exploded view of the ground anchor featuring the compensation plate according to the first embodiment and the fixing flanges bent from the anchor flanges;

DETAILED DESCRIPTION OF THE INVENTION

Figure 1:
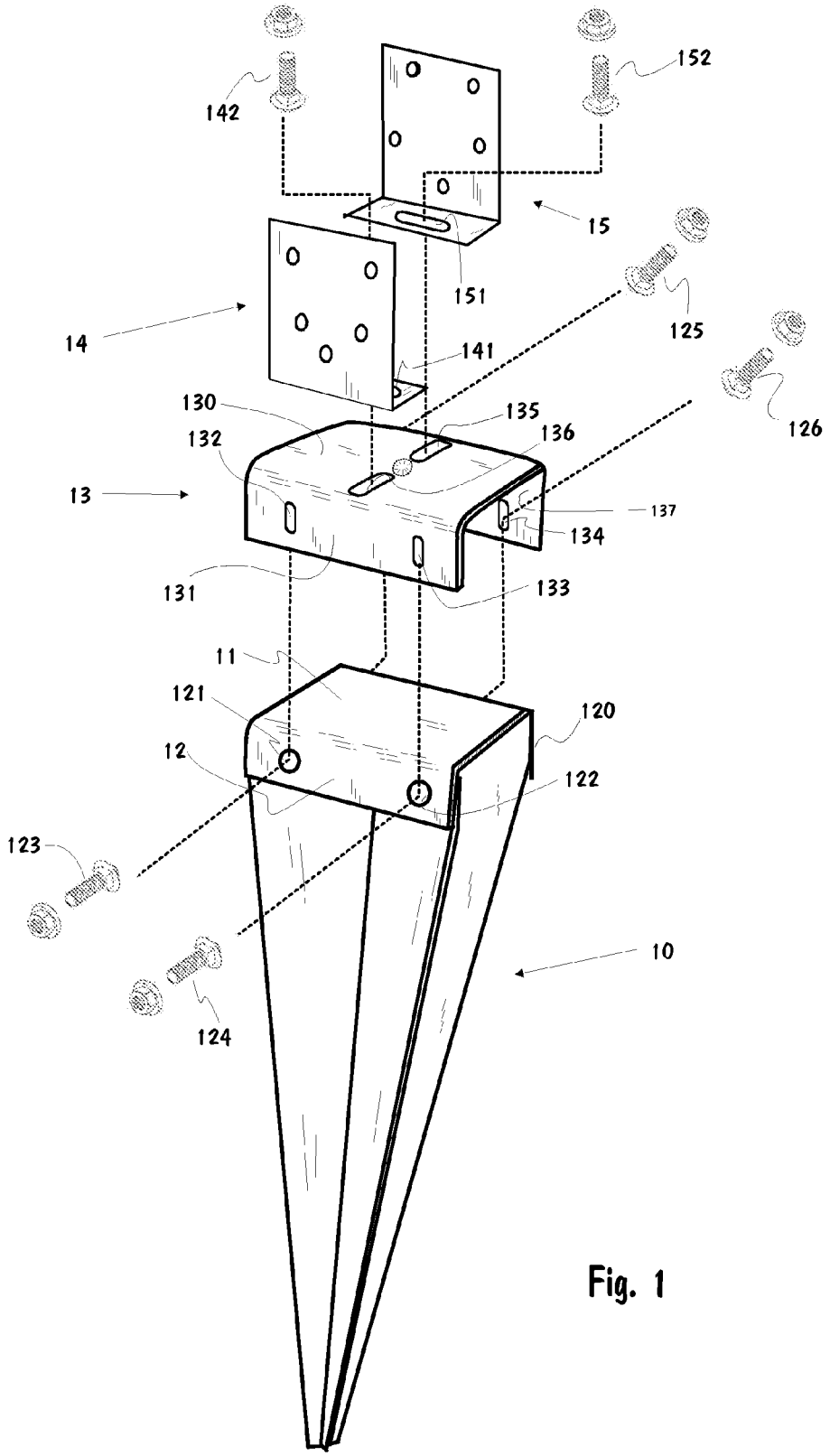
FIG. 1 is an exploded view of the ground anchor having L-shaped brackets for mounting a post and a compensation plate according to the first embodiment.
Figure 2:
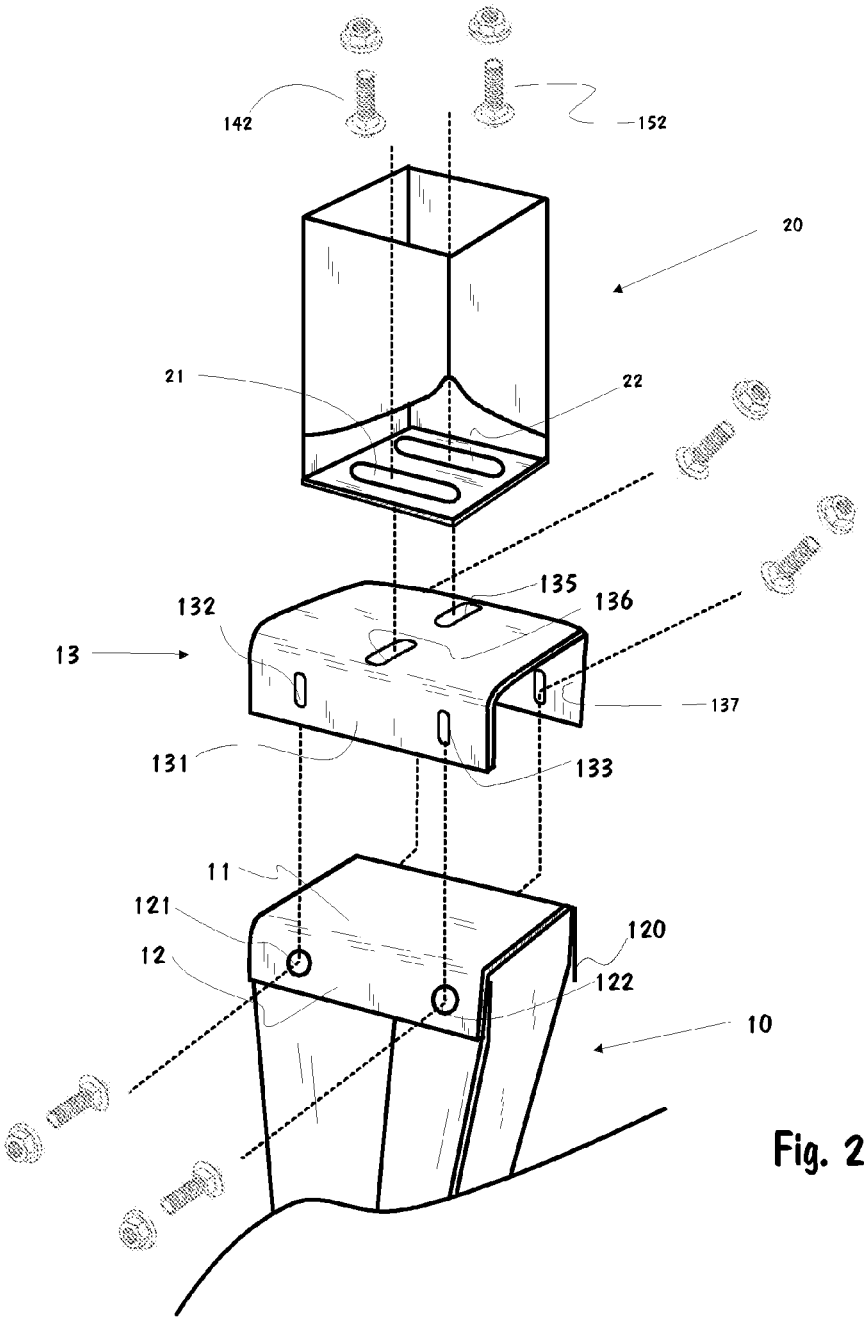
FIG. 2 is an exploded view of the ground anchor having a sleeve for mounting a post and a compensation plate according to the first embodiment.

FIGS. 1 and 2 depict exploded views of a ground anchor with tilt compensation according to the invention: all parts are made of steel.

The ground anchor in FIG. 1 comprise traditional anchor part 10, consisting of the commonly used wedge-shaped steel plates welded together. The anchor part is wedge-shaped, making it easier to ram into the ground, but it can also feature a screw, in which case it is screwed into the ground.

On the top of anchor part 10 is welded a top plate 11 for receiving ramming strokes and transferring the force to the anchor part while protecting the flanges against bending. While the use of a top plate is known, the invention encompass an end plate which has downwards-bent edges forming flanges on opposite sides, only one downwards-bent flange 12 is shown in FIG. 1, each flange having at least one hole. Flange 12 depicted here has two holes: 121 and 122.

A post or pillar, not depicted in the figure, is mounted on the mounting part. In FIG. 1, the mounting part is made of L-brackets 14 and 15. Their structure and function are known, and have been described in detail in patent application U.S. Pat. No. 13/359,757. The L-brackets have adjustment slots 141 and 151 parallel to the crease. As described below, the slots enable through bolts 142 and 152 to move in the slot to facilitate the positioning of the L-brackets in relation to each other and top plate 11. The post is mounted with screws between the upwards protruding flanges of the L-brackets that are respectively equipped with mounting holes for the screws.

FIG. 2 is similar to FIG. 1 excluding the mounting part, which in this case is socket 20 with the same cross-section as the post. The structure consisting an open-ended socket which is welded to the top of the anchor part is known in the art. According to one aspect of this invention, however, the socket is a separate part, which is depicted as a partial cross-section in FIG. 2. The socket has parallel elongated adjustment slots 21 and 22 in the bottom, through which the socket is mounted on the ground anchor with through bolts 141 and 142. The adjustment slots enable movement of the socket within the range of the slots, facilitating the positioning of the socket in relation to end plate 11 before the bolts are tightened. This will be described in detail below. Additionally, the separate socket enables the socket to be selected according to the post or pillar.

Reference is still made to FIGS. 1 and 2. When installing a state-of-art ground anchor, a rock or other hard objects blocking the path of the anchor may cause the anchor to tilt during the ramming. This subsequently leads to a tilted post. In the solution of the present invention, the impact of the tilted anchor on the post is eliminated with special compensation plate 13.

The compensation plate consists of plane 130, which is approximately of the same size and shape as top plate 11 of the anchor part 10, and two mounting flanges, 131, 137, bent 90 degrees downwards at opposite sides of the plate. As shown in FIGS. 1 and 2, each mounting flange has two adjustment slots for through bolts 123, 124, 125 and 126. The adjustment slots are located on the plane, enabling the compensation plate to be moved up or down when the through bolts are in place, before they are tightened.

The plane contains parallel adjustment slots 135 and 136 that can be in a line, as shown in FIGS. 1 and 2, running through the center of the compensation plate perpendicular to mounting flanges 133 and 137. Alternatively, the adjustment slots can be in a line running through the center of the compensation plate and parallel to mounting flanges 133 and 137. However, this will reduce the rigidity of plane 130.

The adjustment slots are used for mounting a post holder, which is flanges 14 and 15 in FIG. 1 or socket 20 in FIG. 2, on the compensation plate. The adjustment slots are used for mounting flanges 14 and 15 or socket 20 on the compensation plate Once the anchor part is rammed into the ground, the post holder is mounted onto it. The mounting is done by inserting through bolts 142 and 152 through the adjustment slots from below the compensation plate and by placing the L-brackets or socket on the compensation plate so that the through bolts run through adjustment slots 141 and 151 or the socket adjustment slots 21 and 22.

The bolts are then tightened lightly. The bolt can be prevented from spinning by using locking bolts with square shoulders inserted into the groove of the adjustment slot of the compensation plate. This step can be performed beforehand, so that there are enough compensation plates with mounted post holders available. Owing to the crossing adjustment slots and bolts, the L-brackets or the socket can be moved in two perpendicular directions on the compensation plate before the bolts are tightened. The L-brackets or the socket can also be turned on the surface, facilitating the positioning of the connector part on the compensation plate.

The compensation plate with the connector part attached thereto, as described above, is then positioned on top of the top plate of the anchor part so that its downwards-protruding mounting flanges 131 and 137 aligning on the downwards-protruding fixing flanges 12 and 120 of the top plate, simultaneously aligning flange holes 121 and 122 (FIGS. 1 and 2) with the adjustment slots. The bolts 123, 124, 125 and 126 are inserted from the back through the holes and slots and initially lightly tightened.

The mounting flanges of the compensation plate are uniform throughout the plane 13. This makes the structure rigid, requiring a certain amount of force to bend the flanges. However, it is beneficial that the bending is facilitated during compensation, wherein a compensation plate type of FIG. 3 is a good choice.

Figure 3:
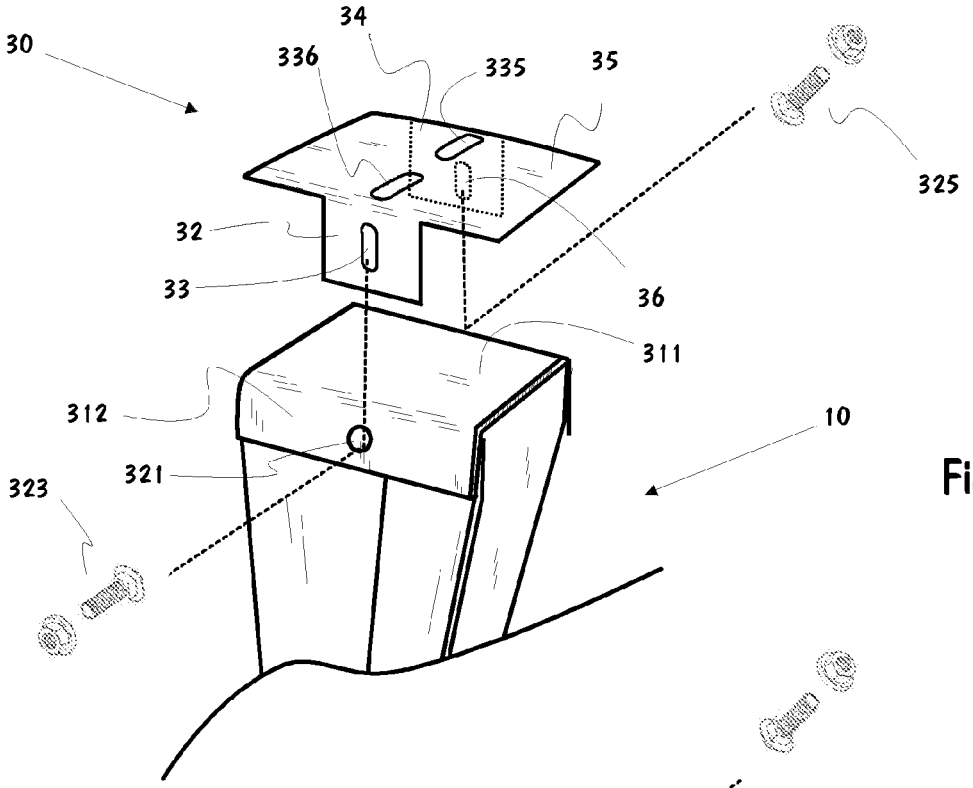
FIG. 3 is an exploded view of the ground anchor having a compensation plate according to the second embodiment.

The plane of compensation plate 30 in FIG. 3 is similar to that depicted in FIGS. 1 and 2, but the downwards-bent flanges 32 and 34, the latter of which is depicted with a dash line, are not uniform throughout the length of the top surface 35. Instead, the flange is formed by a tab, the width of which is, for example, ⅓ of the length of the top surface side and located symmetrically in the center region of the side. In this case, the flanges have only one adjustment slot 33, 36.

Similarly, the downwards-bent flanges of top plate 311 (flange 312 depicted), have only one hole (hole 321 depicted) for through bolts 323 and 325. Adjustment slots 335 and 336 located on the plane of the compensation plate are similar to FIGS. 1 and 2, and the post holder is mounted onto it similarly.

The benefit of this compensation plate is that it is easy to tilt around the bolt axis as through bolts, 323 and 325, act as the swivel axis. Furthermore, the tab yields rather easy if the compensation plate is bent towards the bolt axis, changing the original 90-degree angle between the tabs and the plane.

Figure 4:
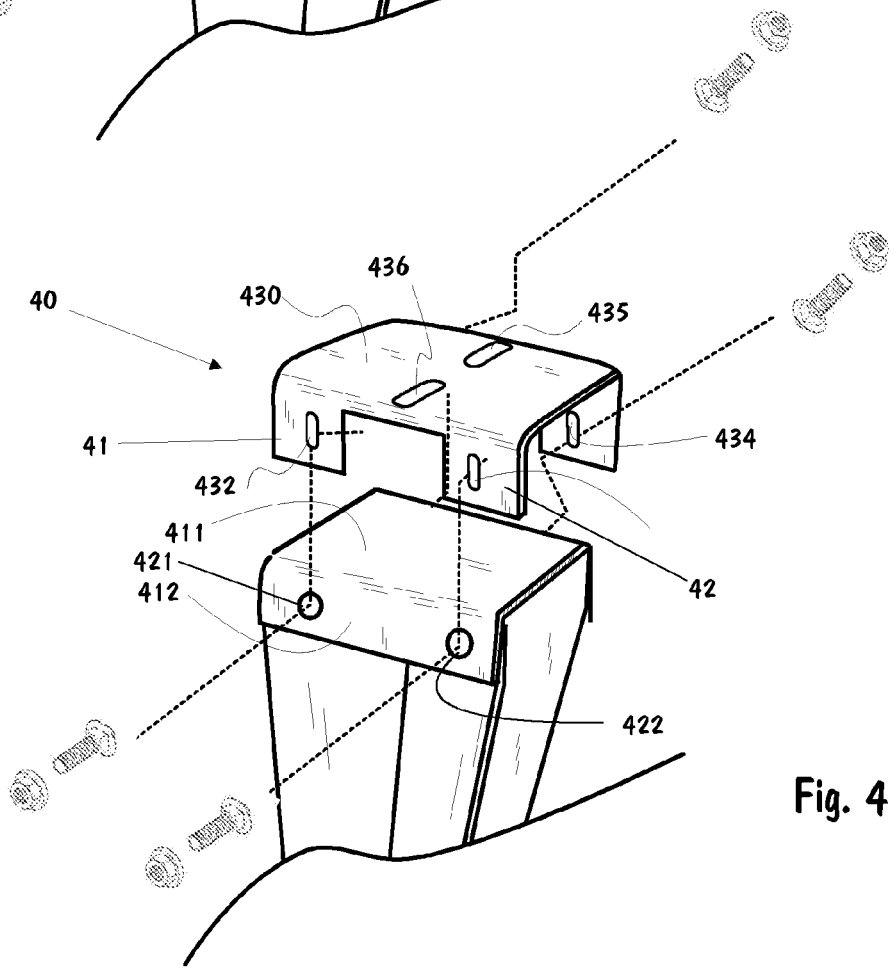
FIG. 4 is an exploded view of the ground anchor having a compensation plate according to the third embodiment.

FIG. 4 depicts another embodiment of the compensation plate. The plane of compensation plate 40 is similar to that depicted above, but the downwards-bent flanges are not uniform throughout the length of the top surface 430. Instead, the flange is formed by two tabs (41 and 42), the width of which is, for example, 13 of the length of the top surface, located symmetrically on the edges of the side, leaving a gap between the tabs. The tabs have a single adjustment slot (432, 433, and 434).

Similarly, the downwards-bent flanges of top plate 411 (flange 412 depicted), have only two holes (hole 421, 422 depicted) for through bolts. Adjustment slots 435 and 436 located on the plane of the compensation plate are similar to the those in FIGS. 1, 2 and 3 and the post holder is mounted onto it similarly.

This embodiment of compensation plate is very beneficial. It allows the plate to be bent in a desired direction. The two tabs bend enough when bending the compensation plate along the axis of the through bolts, changing the original 90-degree angle between the tabs and the plane. The plate is mounted to the fixing flanges of the top plate with two through bolts per side, making the mount very rigid and very durable against the torque created during ramming of the post.

Figure 5:
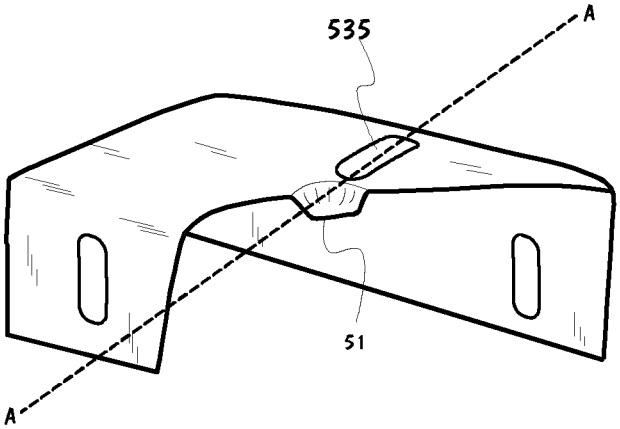
FIG. 5 is a partial cross section of the compensation plate featuring a protrusion on the bottom side.
Figure 6:
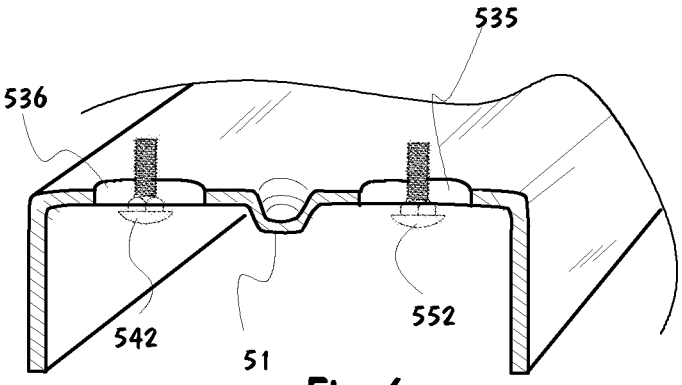
FIG. 6 is a cross section along line A-A of the compensation plate in FIG. 5.

FIGS. 5 and 6 depict an optional feature of the compensation plate. The compensation plate in FIG. 5, depicted as a partial cross-cut, has downward protrusion 51 located in the center of the plate. The protrusion is created preferably by pressing the plate with the appropriate tool. The height of the protrusion from the lower surface of the plate is at least equal to the height of the head of the bolt used for fixing the L-brackets or the sleeve to the compensation plate. When the compensation plate is slightly mounted on the fixing flanges of the anchor part, the protrusion allows the compensation plate to be tilted in any direction while providing support by leaning on the top plate. This feature facilitates the vertical adjustment of the compensation plate in case the anchor part is tilted.

FIG. 5 is a cross section along line A-A in FIG. 4. It depicts protrusion 51 locating between adjustment slots 535 and 536 and that the height of the protrusion exceeds the height of the heads of through bolts 543 and 552.

Figure 8:
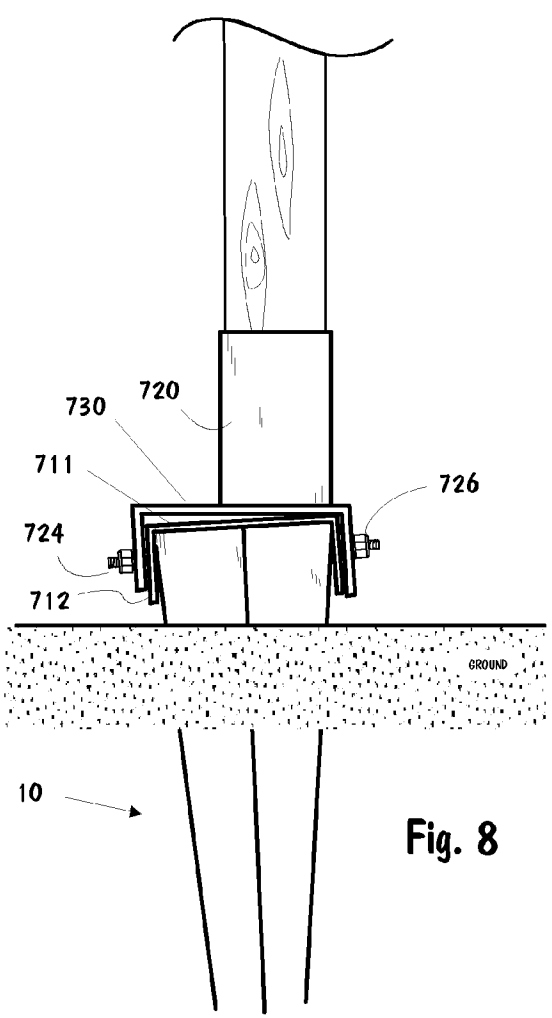
FIG. 8 depicts the tilt compensation of the ground anchor along the fence.
Figure 7:
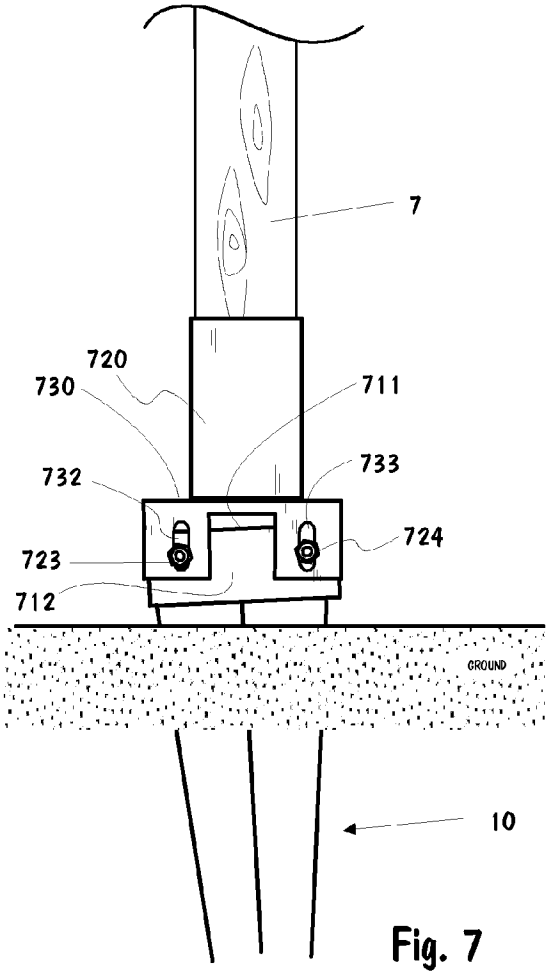
FIG. 7 depicts the tilt compensation of the ground anchor viewed towards a fence

Next, FIGS. 7 and 8 depict erecting a post as a ground anchor according to the invention is utilized. FIG. 8 depicts FIG. 7 viewed from the right.

The figures depict a situation where anchor part 10 has hit a rock while it was rammed into the ground, causing it to tilt. In the figures, anchor part 10 is tilted to the left seen from viewing direction of FIG. 7. In FIG. 8, the anchor can be seen tilted also to the left. Should fence post 7 be mounted in this case, it would be similarly tilted. However, the tilt would be compensated for with the compensation plate prior to the mounting. In these figures, the compensation plate is as shown in FIG. 4 while the connector part is the post socket as shown in FIG. 2.

After the anchor part is rammed into the ground, the connector part (socket 720 in this case) is lightly mounted onto the compensation plate. This step can be performed beforehand as well. Compensation plate 740 and the socket are then placed on the top plate of the anchor part so that the compensation plate flanges and the fixing flanges of top plate 712 align. The adjustment slots and flange holes are now aligned. Bolts 723 and 724 are then inserted from the back through the flange holes of the anchor part and the slots of the compensation plate and initially slightly tightened.

Then the tip of the fence post is inserted into the socket without fixing it with screws. The upright position of the post is verified with a bubble level. As the post is tilted, it is straightened, and with a bubble level is verified that the post stands upright. The compensation plate bolts are tightened lightly so allowing the plate to be moved in relation to the fixed anchor part. Now mounting bolts 723 and 724 and similar bolts on the opposite side of compensation plate 740 can be tightened properly. The result is that although the anchor part and its end plate are tilted, the compensation plate is horizontal. The gap between those two parts increases in FIGS. 7 and 8 towards the right. The compensation plate is in contact with the top plate on a very small area: the far right corner in FIG. 7 and the near right corner of FIG. 8.

If the angle required for compensating the tilt is extensive in the direction of the bolt axis, exceeding the adjustment length of the slots in the compensation plate, the compensation plate flanges yield when pushing the fence post straight, changing the original 90-degree angle between the flanges and the plane. This is depicted in FIG. 8.

Following this, socket 720 is positioned on the compensation plate. While the bolts of the socket are not yet tightened, the socket can be slid along the surface of the compensation plate along the adjustment slots. During the fence building process, the alignment of the fence post is checked, and the displaced post can be slid along the adjustment slots to align it with the correct fence line. The adjustment slots also enable rotation of the socket along its longitudinal axis, facilitating the alignment of the post edges with other posts. Once correct positioning is achieved, the post is removed from the socket and the through bolts located on the bottom of the socket are tightened properly. Finally, the fence post is inserted and fixed into the socket.

FIGS. 9A and 9B depict an inexpensive method of creating fixing flanges. FIG. 9A depicts a situation before the flanges are bent; FIG. 9B depicts the situation after the flanges are bent. In this case, the fixing flange is not formed from the top plate flange; but it is created by bending the outer top tip of the wedge-shaped plate 90 (only one plate depicted) of the anchor part along axis B-B, forming tab 91. Before the bending, hole 1022 has been drilled into the tab for the compensation plate mounting bolt. The bending can be done before the wedge-shaped plates are welded together.

FIG. 9C depicts the anchor part viewed from the top. The anchor consists of four wedge-shaped plates welded together along their longer edges with each plate at a 90-degree angle to the adjacent plate. Top plate 1011 is welded to the top of the wedge-shaped plates, acting as a ramming plate. The top plate does not need to cover the entire end surface; it can be made smaller, facilitating the installation of mounting bolts 92. The figure indicates how the fixing tabs in adjacent plates are turned away from each other. This facilitates the insertion of the bolts due to the space located behind the tabs. The compensation plate is mounted to the fixing tabs as described above. The ground anchor is rammed when erecting the fence with the fixing tabs parallel to the fence. In this case, the bolts are easy to loosen afterward without obstruction from the fence if the post requires straightening due to tilting resulting from ground frosting. The tabs can also be bent towards each other, making the outer dimensions of the anchor part slightly smaller, eliminating protrusions, but also making it more inconvenient to install the bolts.

FIG. 10 is mainly similar to FIG. 2, excluding the top plate 11 in FIG. 2, which is replaced here by the smaller plate 1011 which does not contain fixing flanges. The fixing flanges are replaced by fixing tabs 91 done in ground anchor 1010 as shown in FIGS. 9B-C.

In this structure, the top plate 1011 can also be larger than depicted, or it can be left out completely. In this case, ramming the ground anchor requires the use of an appropriate intermediary piece placed on the top of the ground anchor for the duration of the ramming.

Figure 11:
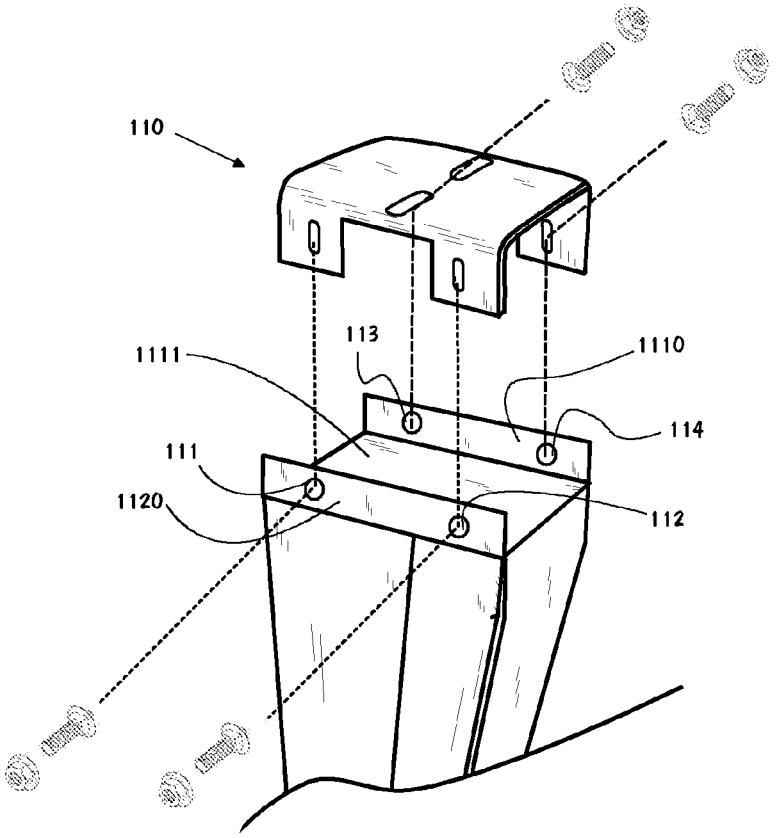
FIG. 11 is an exploded view of the ground anchor featuring the compensation plate according to the second embodiment, where the fixing flanges are formed by bending the top plate flanges upwards.

FIG. 11 depicts another option of forming the fixing tabs. In this case, unlike FIGS. 1-4, the end plate 1111 flanges are not formed by bending downwards, but by bending upwards in order to create flanges 1110 and 1120. Holes 111-114 are drilled into the flanges according to the selected compensation plate. In this case, the compensation plate 110 is pursuant to FIG. 4. The flanges act as mounting tabs. The flange does not have to be uniform, as depicted in the figure; it can also be finger-shaped, with each finger acting as a mounting tab.

Figure 12:
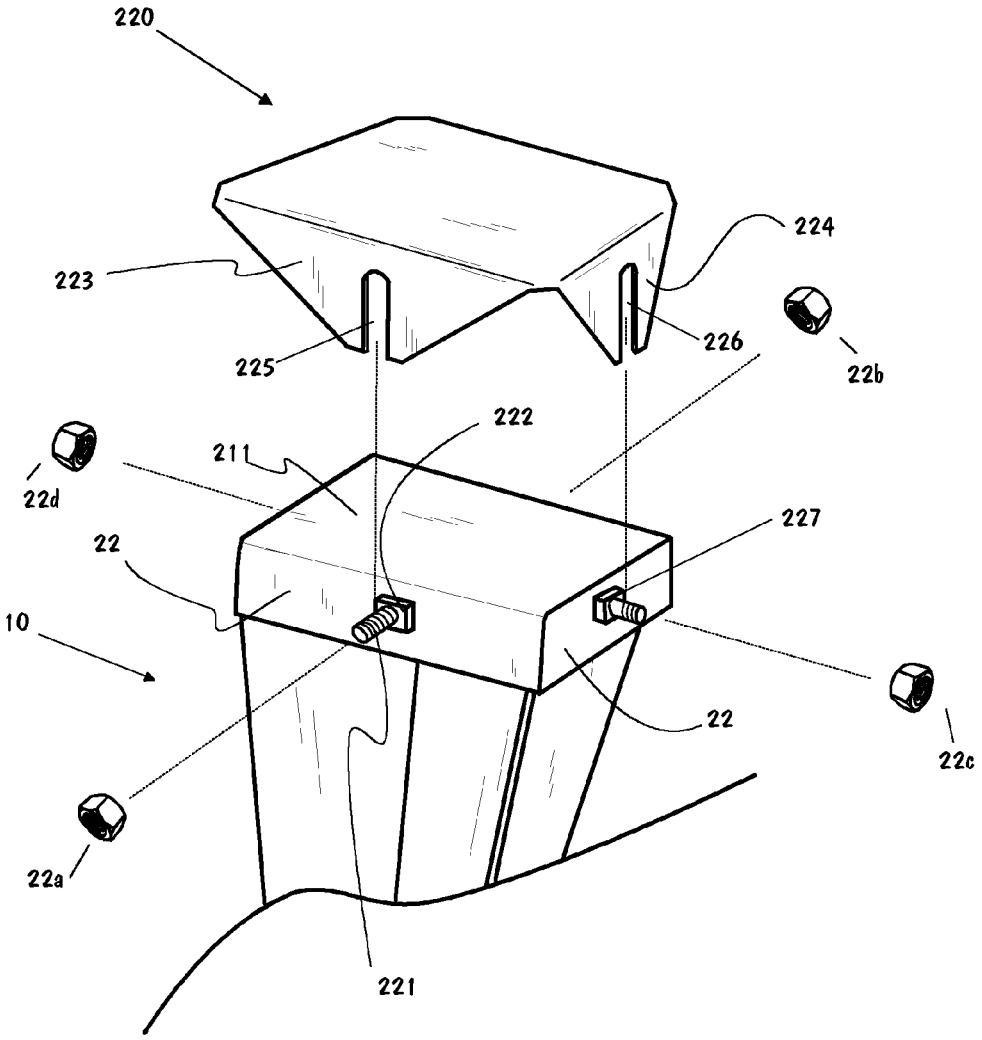
FIG. 12 is an exploded view of the ground anchor featuring a compensation plate according to the fourth embodiment.

FIG. 12 depicts the fourth embodiment of the compensation plate. Top plate 211 located on the top of anchor part 10 is similar to FIG. 1, but its edges are bent downwards on all sides, forming flanges 22. There is not an open bolt hole in the flange; instead, bolt 221 is fixed permanently onto the flange, the bolt head being against the inner surface of the flange and the shank protruding from the outer surface of the flange. There is a spacer 222 in the foot of the bolt.

The bolt can be installed by, for example, bringing the bolt through the hole in flange 22 from the back, in which case the bolt head is against the inner surface of the flange, and by tightening the bolt against the front side of the flange with a nut. In this case the nut automatically forms a spacer. Another alternative is to weld the bolt by its bolt head against the outer surface of the flange or to weld a spindle on a piece of steel sheet which is welded onto the flange.

In this embodiment compensation plate 22 is similar to compensation plate 30 in FIG. 3. The difference is that the downwards-bent flanges (223 and 224 depicted) are located on each side of the plate. The figure shows triangular flanges with elongated slots (slots 225 and 226 depicted) having the width of the diameter of bolt shank 221. The flanges are easy to form by bending the corners of a square metal plate downwards.

During installation, the compensation plate is placed on the top plate 211, aligning the bolts with the slots of the flanges of the compensation plate, and on the spacers (spacers 222 and 227 depicted). Then, bolts 22*a-d* are tightened slightly. Once the post is inserted into the socket (not depicted), it is straightened. The compensation plate enables the post to be easily tilted in every direction. Thanks to the spacers, the flanges are subjected to only minor bending forces. Finally, the nuts are tightened properly, and the installation is complete.

The benefit of the invention is the quick and easy compensation of the ground anchor tilting and the possibility of positioning the post holder. This makes it easy to straighten and align the post with the fence line. The ground anchor is rammed into the ground so that the compensation plate mounting bolts point away from the fence. This makes it easier to access the bolts and compensate any tilting resulting later from, e.g., ground frosting.

The invention can be implemented in ways other than those indicated above while observing the patent requirements and definitions. The compensation plate may feature different mounting flanges, and their number and location does not necessarily need to be identical. The shape and form of the adjustment slots located on the plane of the compensation plate are not limited to the aforementioned cases. Furthermore, various other types of post holders can be used, and the connector can also be welded onto the compensation plate. However, this will eliminate the possibility of positioning the connector.

The invention claimed is:

1. A ground anchor with tilt compensation, comprising:

an anchor part consisting of a wedge-shaped part to be rammed or screwed into ground and a top plate;

a post holder for holding a foot of a post;

fixing flanges at the anchor part, wherein the fixing flanges are perpendicular to the top plate and through bolts are attached thereto; and a compensation plate, a plane of which is located above the top plate and is provided with slots for fastening the compensation plate to the post holder with the through bolts, and at least one mounting flange abutting the plane of the compensation plate at least at two opposite edges of the compensation plate, protruding downwards and facing the fixing flanges and having at least one adjustment slot parallel to the at least one mounting flange enabling a through bolt to run through the at least one adjustment slot, wherein the at least one adjustment slot allows adjustment of the compensation plate before nuts of the through bolts are tightened in order to achieve a horizontal positioning of the compensation plate regardless of a tilt of the top plate.

2. The ground anchor as in claim 1, wherein the width of the at least one mounting flange is the same as the length of an edge to which the at least one mounting flange abuts.

3. The ground anchor as in claim 1, wherein the at least one mounting flange is located in middle regions of the two opposite edges to which the at least one mounting flange abuts, the width of the at least one mounting flange being smaller than the length of the two opposite edges to which the at least one mounting flange abuts.

4. The ground anchor as in claim 1, wherein the at least one mounting flange has at least two portions located at opposite ends of the two opposite edges to which the at least one mounting flange abuts.

5. The ground anchor as in claim 1, further comprising two adjustment slots on the plane of the compensation plate for post holder bolts, wherein the adjustment slots are located in line perpendicular to opposite edges of the compensation plate.

6. The ground anchor as in claim 1, further comprising two adjustment slots on the plane of the compensation plate for post holder bolts, wherein the adjustment slots are located in a line parallel to the two opposite edges of the compensation plate.

7. The ground anchor as in claim 1, wherein the top plate covers a top of the anchor part and the fixing flanges are formed of top plate flanges that protrude downwards from a top plate surface on two opposite edges, the fixing flanges having at least one hole for mounting through bolts.

8. The ground anchor as in claim 1, wherein the anchor part consists of wedge-shaped parts welded together and the fixing flanges are formed by bending top tips of anchor flanges.

9. The ground anchor as in claim 8, wherein the fixing flanges are bent away from one another on one side.

10. The ground anchor as in claim 1, wherein the post holder consists of a post socket having at least one adjustment slot in bottom for mounting through bolts, enabling the post socket to be moved along the plane of the compensation plate before mounting through bolts are tightened.

11. The ground anchor as in claim 1, wherein the post holder consists of two L-shaped brackets having adjustment slots located on flanges resting against a surface of the compensation plate for mounting bolts, wherein the adjustment slots of the compensation plate and the L-brackets enable the L-brackets to be moved along the plane of the compensation plate before the mounting bolts are tightened.

12. The ground anchor as in claim 1, comprising a protrusion in a middle region of a lower surface of the plane of the compensation plate, a height of the protrusion exceeding a height of a mounting bolt head, wherein the mounting bolt head provides a pivot support during adjustment of the compensation plate.

13. The ground anchor as in claim 1, comprising spacers on the fixing flanges of the anchor part, wherein the spacers keep the fixing flanges apart from the mounting flanges of the compensation plate.

* * * * *